US007139680B2

(12) United States Patent
Orozco

(10) Patent No.: US 7,139,680 B2
(45) Date of Patent: Nov. 21, 2006

(54) APPARATUS AND METHOD FOR STANDBY LIGHTING

(75) Inventor: Sergio Orozco, Tijuana (MX)

(73) Assignee: Crydom Limited, Jersey (GB)

( * ) Notice: Subject to any disclaimer, the term of this patent is extended or adjusted under 35 U.S.C. 154(b) by 5 days.

(21) Appl. No.: 10/891,881

(22) Filed: Jul. 15, 2004

(65) Prior Publication Data

US 2006/0015273 A1 Jan. 19, 2006

(51) Int. Cl.
*H05B 37/00* (2006.01)

(52) U.S. Cl. ..... 702/188; 315/86; 307/46

(58) Field of Classification Search ..... None
See application file for complete search history.

(56) References Cited

U.S. PATENT DOCUMENTS 3,894,265 A * 7/1975 Holmes et al. ..... 315/194
4,042,856 A * 8/1977 Steigerwald ..... 315/246
4,785,456 A * 11/1988 Kaplan ..... 372/38.09
5,442,261 A * 8/1995 Bank et al. ..... 315/307
5,471,114 A * 11/1995 Edwards et al. ..... 315/86
5,650,694 A * 7/1997 Jayaraman et al. ..... 315/225
5,677,602 A * 10/1997 Paul et al. ..... 315/224
5,751,115 A * 5/1998 Jayaraman et al. ..... 315/225
5,872,429 A * 2/1999 Xia et al. ..... 315/194
6,515,437 B1 * 2/2003 Zinkler et al. ..... 315/312
6,784,624 B1 * 8/2004 Buonocunto ..... 315/247
2003/0110405 A1 * 6/2003 Ryu ..... 713/320
2005/0169019 A1 * 8/2005 Konno ..... 363/49
2005/0258796 A1 * 11/2005 Kusaka ..... 318/801
2005/0259448 A1 * 11/2005 Koike ..... 363/21.01

* cited by examiner

*Primary Examiner*—Carol S. W. Tsai
(74) *Attorney, Agent, or Firm*—Gibson, Dunn & Crutcher LLP

(57) ABSTRACT

A method and system for standby lighting uses a power supply module and a standby lamp in conjunction with an HID lamp. The power supply module has a processor with smart trigger circuitry, soft start capability, overlap timer, and an advanced current sense algorithm. The power supply module continuously monitors the electronic ballast current to the HID lamp. If the current drops for a period of time, the power supply module supplies DC current to turn on the standby lamp gradually over a couple of seconds. The standby lamp is kept on while the processor checks for a rise in the electronic ballast current to a threshold current level for more than two seconds. Then, an overlap timer starts to count down for the time it takes for HID lamp to reach full intensity, approximately fifteen minutes. The standby lamp is turned off at the end of the count down.

21 Claims, 7 Drawing Sheets

APPARATUS AND METHOD FOR STANDBY LIGHTING

FIELD OF THE INVENTION

This invention relates to high intensity discharge ("HID") lamps, and more particularly, to standby lamps used in conjunction with HID lamps in the event of momentary power loss, and even more particularly, to a power supply module for supplying power to the standby lamps when a momentary power loss occurs to provide standby lighting.

BACKGROUND OF THE INVENTION

High intensity discharge lamps are typically used when high levels of light are required over large areas and when energy efficiency and/or long life are desired. These areas include gymnasiums, large public areas, warehouses, manufacturing facilities, outdoor activity areas, roadways, parking lots, and pathways. Like fluorescent lamps, HID lamps require a ballast which provides the necessary circuit conditions for starting and maintaining their operation. When HID lamps are initially turned on, it takes anywhere from five to fifteen minutes, depending upon the particular HID lamp, for the normal light intensity level to be reached. When a momentary interruption of the line voltage occurs, the same time period is required to restore the HID lamp to its normal intensity level. For situations where the lack of light for this time period is unacceptable, standby lamps (also referred to as auxiliary lamps) are typically incorporated into the lighting system. Usually, the conventional ballasts for the HID lamps have provided a voltage supply and trigger circuitry to turn on the auxiliary lamps until the HID lamps reach their normal intensity level. Then, the auxiliary lamps are turned off by the circuitry.

Conventional ballasts can operate over wide standard input voltages, typically 208–277 volts AC, which can normally be preset by the end user. The auxiliary lamps used in conjunction with HID lamps typically only operate at 120 volts AC. Conventional ballasts typically provide a transformer for the auxiliary lamp. Trigger circuitry for the auxiliary lamp is actuated by an electromechanical relay where the coil is connected in series to the HID lamp and the relay contacts are connected in series to the auxiliary lamp. When the HID lamp breaks down, such as occurs with a temporary loss of line voltage, the full voltage is presented on the coil, the relay contacts close, and the auxiliary lamp turns on.

Conventional ballasts are being rapidly being replaced with electronic ballasts which do not provide a voltage supply and trigger circuitry for systems that require auxiliary lamps. There is thus a need in the art to supply such a system.

DETAILED DESCRIPTION OF THE INVENTION

Figure 1:
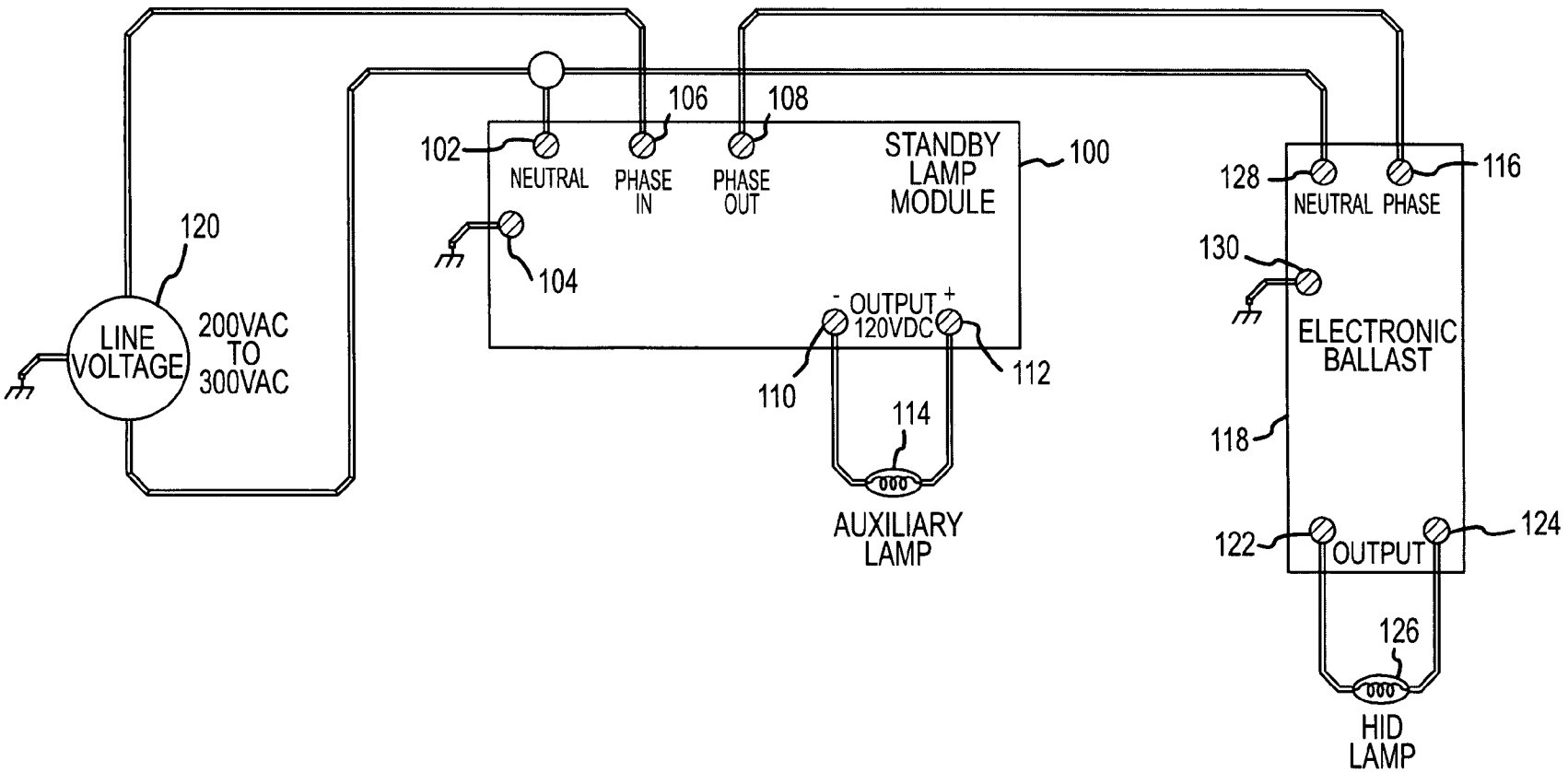
FIG. 1 shows a wiring diagram for a typical application of an embodiment of the power supply module for a standby lamp, used in conjunction with an HID lamp, of the present invention.

Referring now to the Figures, in which like reference numerals and names refer to structurally and/or functionally similar elements thereof, FIG. 1 shows a wiring diagram for a typical application of an embodiment of the power supply module for a standby lamp, used in conjunction with an HID lamp, of the present invention. Referring now to FIG. 1, Standby Lamp Module 100 has a three wire input: Neutral Terminal 102, Ground 104, and Phase which is made up of Phase In Terminal 106 and Phase Out Terminal 108. Two Output Terminals 110, 112 supply 120 volts DC to Auxiliary Lamp 114. Phase Out Terminal 108 is connected to Phase Input Terminal 116 of Electronic Ballast 118, and Neutral Terminal 102 is connected to Neutral Input Terminal 128 of Electronic Ballast 118. Line Voltage Supply 120 supplies between 200 to 300 volts AC to Standby Lamp Module 100 and Electronic Ballast 118. Electronic Ballast 118 has two Output Terminals 122, 124 which supply HID Lamp 126 with the 200 to 300 volts AC. Electronic Ballast 118 also has Neutral Input 128 and Ground 130.

Figure 2:
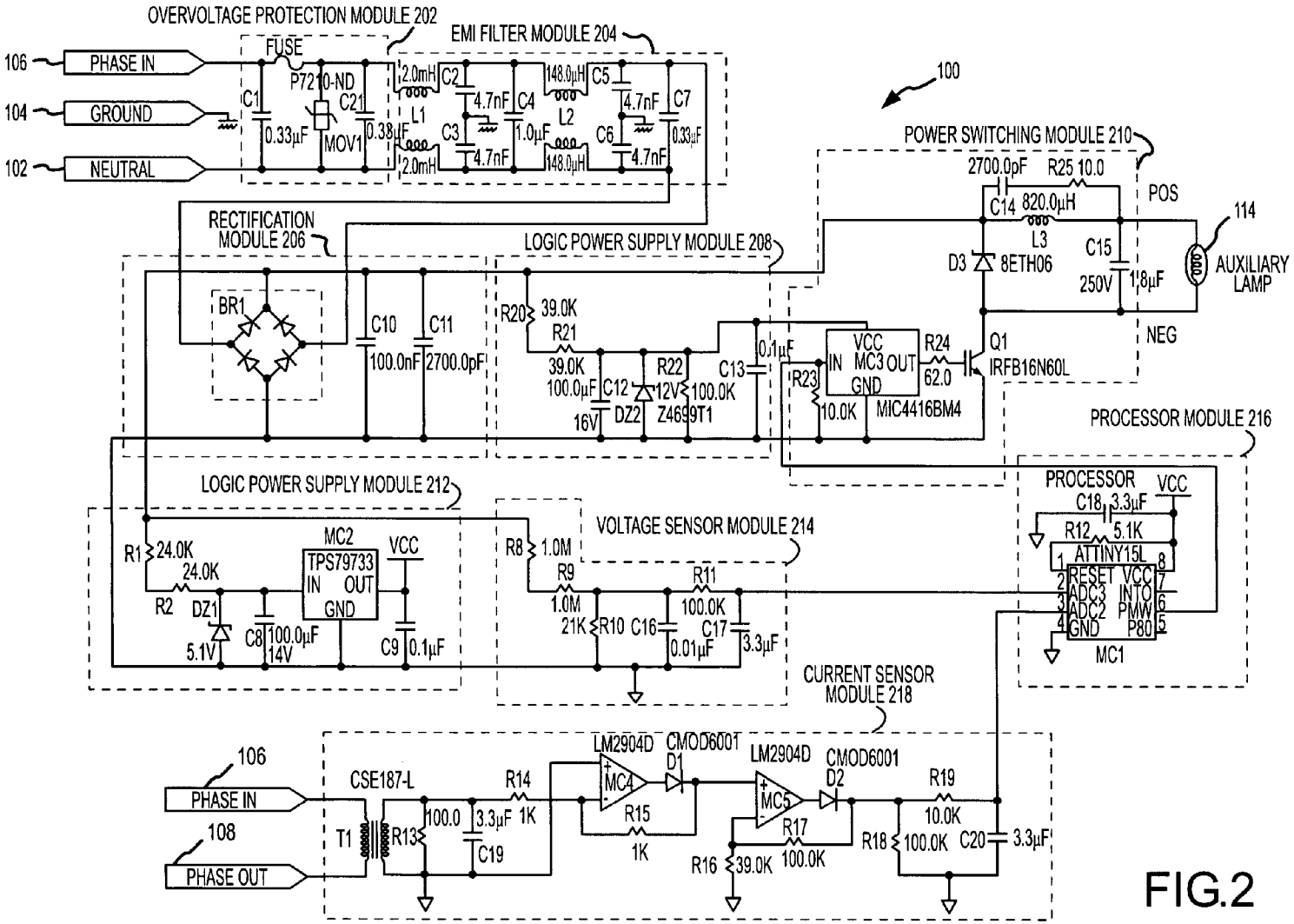
FIG. 2 shows an electronic schematic diagram of an embodiment of the power supply module for a standby lamp, used in conjunction with an HID lamp, of the present invention.

FIG. 2 shows an electronic schematic diagram of an embodiment of the power supply module for a standby lamp, used in conjunction with an HID lamp, of the present invention. Referring now to FIG. 2, Standby Lamp Module 100 provides a regulated power supply and trigger circuitry in a single module. In a phase control mode technique, two silicon controlled rectifiers ("SCR's") connected back to back could be used to reduce the voltage supplied to Auxiliary Lamp 114. Even though the resulting voltage is 120 volts true root mean square ("trms"), the voltage peaks are very high for typical incandescent auxiliary lamps and is not recommended.

One embodiment of the invention reduces these high voltage peaks by employing a switching mode technique instead of a phase control mode technique. A twenty-five KHz carrier frequency is used along with a metal oxide semiconductor field effect transistor ("MOSFET"), or an insulated gate bipolar transistor ("IGBT"), as a power switching device and power inductor in series with Auxiliary Lamp 114. The MOSFET embodiment is shown in FIG. 2. Consequently, a rectified sine waveform is supplied to Auxiliary Lamp 114.

One skilled in the art will recognize that one of the relevant changes to prior art practice provided by Standby Lamp Module 100 is that 120 volts DC, instead of 120 volts AC, is supplied to Auxiliary Lamp 114. Because Auxiliary Lamp 114 is typically a quartz incandescent type lamp, it can operate with either AC or DC voltage. Some incandescent lamps however are very sensitive to pulsed current. This is due to the vibration caused to the filament, which can greatly reduce the life of the filament. Such lamps often have constraints regarding the ratio of root mean square current to average current that precludes the use of a phase controlled 60 Hz approach. The twenty-five KHz chopping frequency utilizing in the present invention eliminates audible noise and reduces the filter component sizes. Thus, Standby Lamp Module 100 can operate with a wide input voltage ranging between 200 to 300 volts AC, and provide a constant voltage of 120 volts DC to Auxiliary Lamp 114 of the incandescent variety that is sensitive to pulsed current.

Standby Lamp Module 100 has several circuit modules that provide the overall functionality as described above and herein below. Overvoltage Protection Module 202 has a varistor to protect Standby Lamp Module 100 against surge peaks and overvoltage. Individual components of Overvoltage Protection Module 202 include: polarized capacitors C1 and C21, metal oxide varistor MOV1, and a Fuse. In one embodiment of the invention, the components of Overvoltage Protection Module 202 have the following values: C1 and C21 are 0.33 μF; MOV1 is a ZNR P7210-ND varistor available from Panasonic; and the Fuse is a 4 ampere 250V AC.

EMI Filter Module 204 reduces the Electro Magnetic Interference ("EMI") conducted emissions to the AC line generated by Standby Lamp Module 100. Individual components of EMI Filter Module 202 include: polarized capacitors C2, C3, C4, C5, C6, and C7 and inductors L1 and L2. In one embodiment of the invention, the components of EMI Filter Module 204 have the following values: C2, C3, C5, and C6 are 4.7 nF, C4 is 1.0 μF, C7 is 0.33 μF, L1 is 2.0 mH, and L2 is 148.0 μH.

Rectification Module 206 provides a suitable DC voltage for Power Switching Module 210 using a diode bridge. Individual components of Rectification Module 206 include: full wave bridge rectifier BR1 and polarized capacitors C10 and C11. In one embodiment of the invention, the components of Rectification Module 206 have the following values: C10 is 100.0 nF and C11 is 2700.0 pF. Polarized capacitors C10 and C11 serve to reduce high frequency.

Logic Power Supply Module 208 regulates the voltage for the MOSFET driver circuitry. In one embodiment of the invention, the regulated voltage is 12 volts DC. Individual components of Logic Power Supply Module 208 include: resistors R20, R21, and R22; polarized capacitors C12 and C13; and zener diode DZ2. In one embodiment of the invention, the components of Logic Power Supply Module 208 have the following values: R20 and R21 are 39.0 k Ohms, R22 is 100.0 k Ohms, C12 is 100.0 μF 16V, C13 is 0.1 μF, and DZ2 is a MMSZ4699T1 12 V SOD-123 available from ON Semiconductor®.

Power Switching Module 210 has an inductor placed in series to the load and MOSFET switching at high frequency to reduce the output voltage. Individual components of Power Switching Module 210 include: low side MOSFET driver MC3; polarized capacitors C14 and C15; resistors R23, R24, and R25; inductor L3; bipolar signal transistor Q1; and diode D3. In one embodiment of the invention, the components of Power Switching Module 210 have the following values: low side MOSFET driver MC3 is an MIC4416BM4 available from Micrel Inc., C14 is 2700.0 pF, C15 is 1.8 μF 250 V, R23 is 10.0 k Ohms, R24 is 62.0 Ohms, R25 is 10.0 Ohms, L3 is 820.0 μH bipolar signal transistor Q1 is an IRFB16N60L 600 V Single N-Channel HEXFET Power MOSFET available from International Rectifier, and D3 is an 8ETH06 600 V 8 A HyperFast Discrete Diode also available from International Rectifier.

Figure 4:
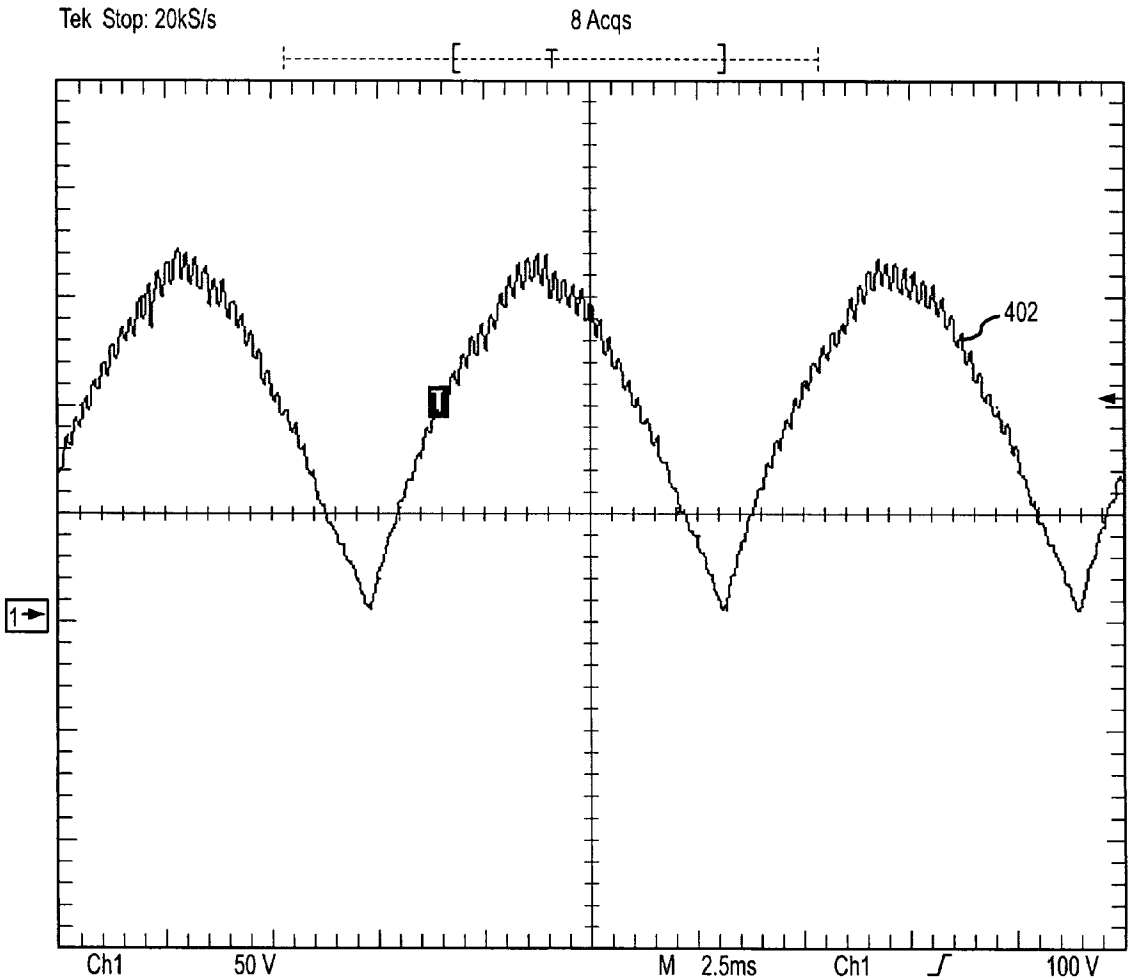
FIG. 4 shows oscilloscope traces of the voltage between the output terminals for the auxiliary lamp in the apparatus and method for standby lighting of the present invention.
Figure 7:
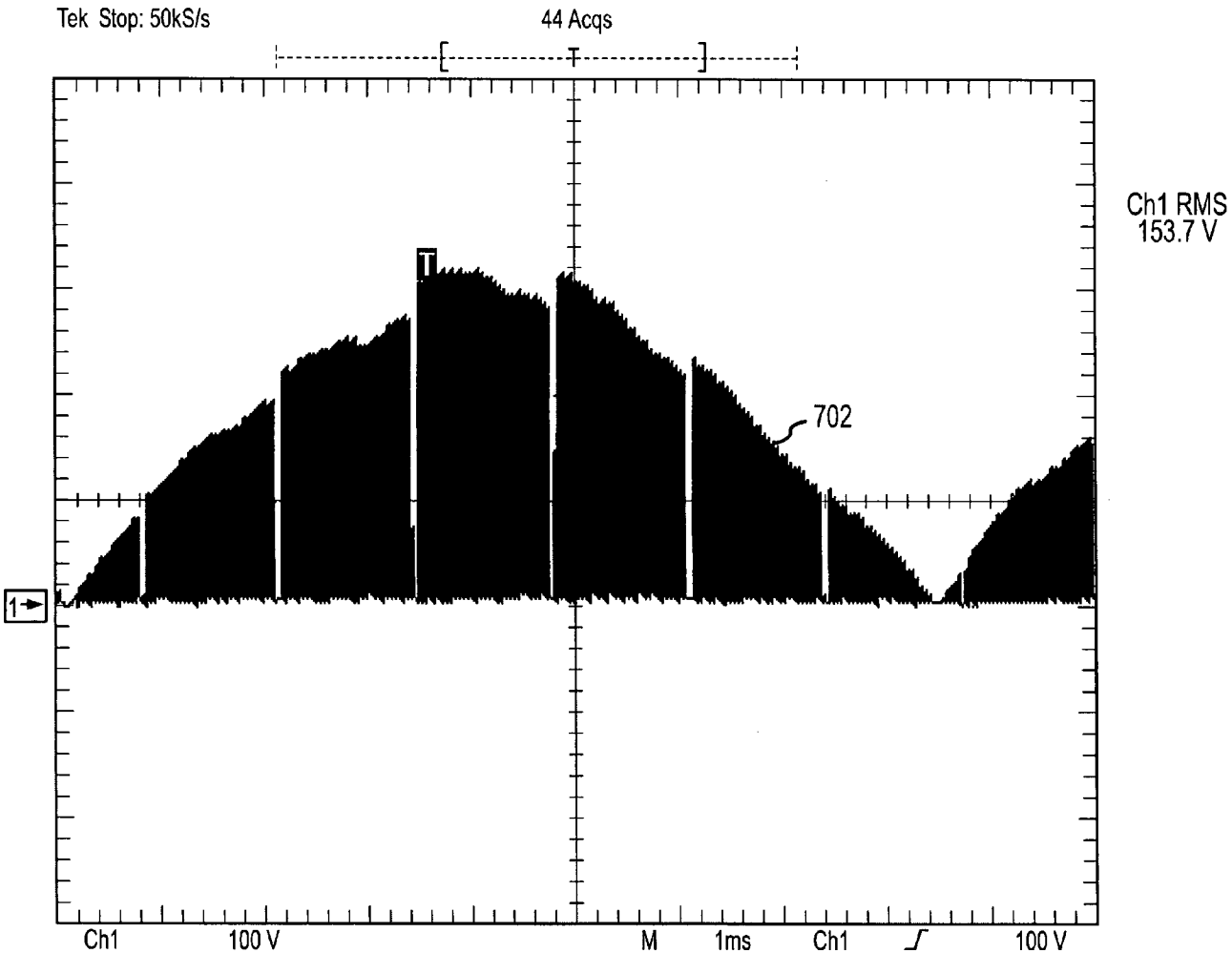
FIG. 7 shows oscilloscope traces of the chopped rectified voltage output waveform of the bipolar signal transistor within the power switching module in the apparatus and method for standby lighting of the present invention.

Inductor L3 is placed in series in order to get the effect of dynamic impedance (high frequency=high impedance, low frequency=short circuit). Polarized capacitor C14 and resistor R25 act as a snubber to reduce noise. FIG. 7 shows oscilloscope traces of the Chopped Rectified Voltage Output 702 of bipolar signal transistor Q1. After being smoothed by polarized capacitor C15, FIG. 4 shows oscilloscope traces of the Constant Voltage Output 402 between Output Terminals 110 and 112 for Auxiliary Lamp 114.

Logic Power Supply Module 212 regulates the voltage for the microcontroller and its peripherals. In one embodiment of the invention, the regulated voltage is 3.3 volts DC. Individual components of Logic Power Supply Module 212 include: resistors R1 and R2; zener diode DZ1; polarized capacitors C8 and C9; microcontroller MC2; and control circuit DC bus VCC for sensing and regulating circuits. In one embodiment of the invention, the components of Logic Power Supply Module 212 have the following values: R1 and R2 are 24.0 k Ohms, DZ1 is an MMSZ4689T1 5.1 V SOD-123 available from ON Semiconductor®, C8 is 100.0 μF 14 V, C9 is 0.1 μF, and MC2 is a TPS79733 10 mA 3.3 V Micro-Power Low-Dropout ("LDO") Voltage Regulator in SOD-123 available from Texas Instruments.

Figure 5:
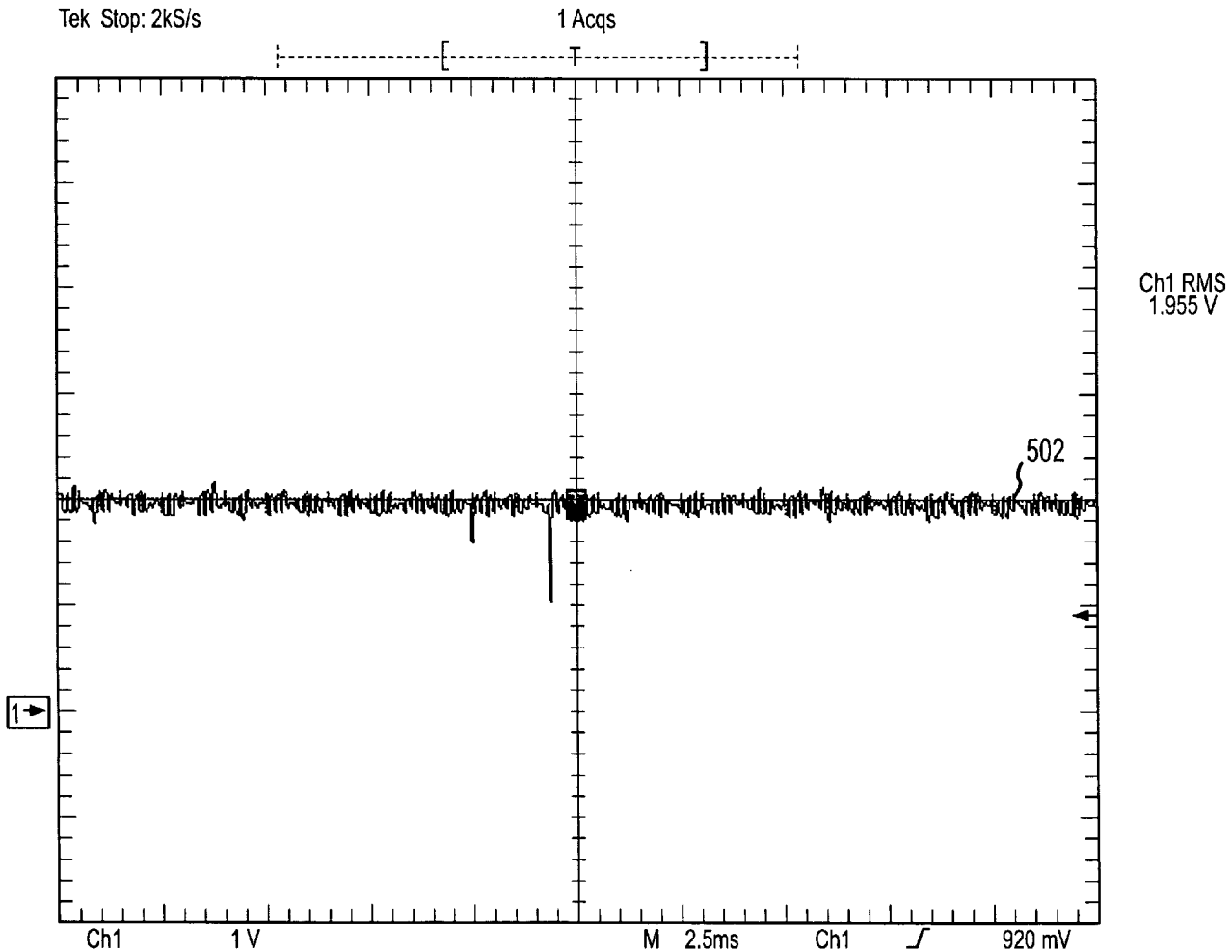
FIG. 5 shows oscilloscope traces of the feedback signal from the voltage sensor module which is proportional to the line voltage in the apparatus and method for standby lighting of the present invention.

Voltage Sensor Module 214 senses the input signal, which is proportional to the line voltage that is used to maintain constant output voltage, which is accomplished by adjusting the switching frequency. Individual components of Voltage Sensor Module 214 include: resistors RB, R9, R10, and R11 and polarized capacitors C16 and C17. In one embodiment of the invention, the components of Voltage Sensor Module 214 have the following values: C16 is 0.01 μF, C17 is 3.3 μF, R8 and R9 are 1.0 M, R10 is 21.0 k Ohms, and R11 is 100.0 k Ohms. FIG. 5 shows oscilloscope traces of the Feedback Signal 502 from Voltage Sensor Module 214 which is proportional to the line voltage.

Figure 6:
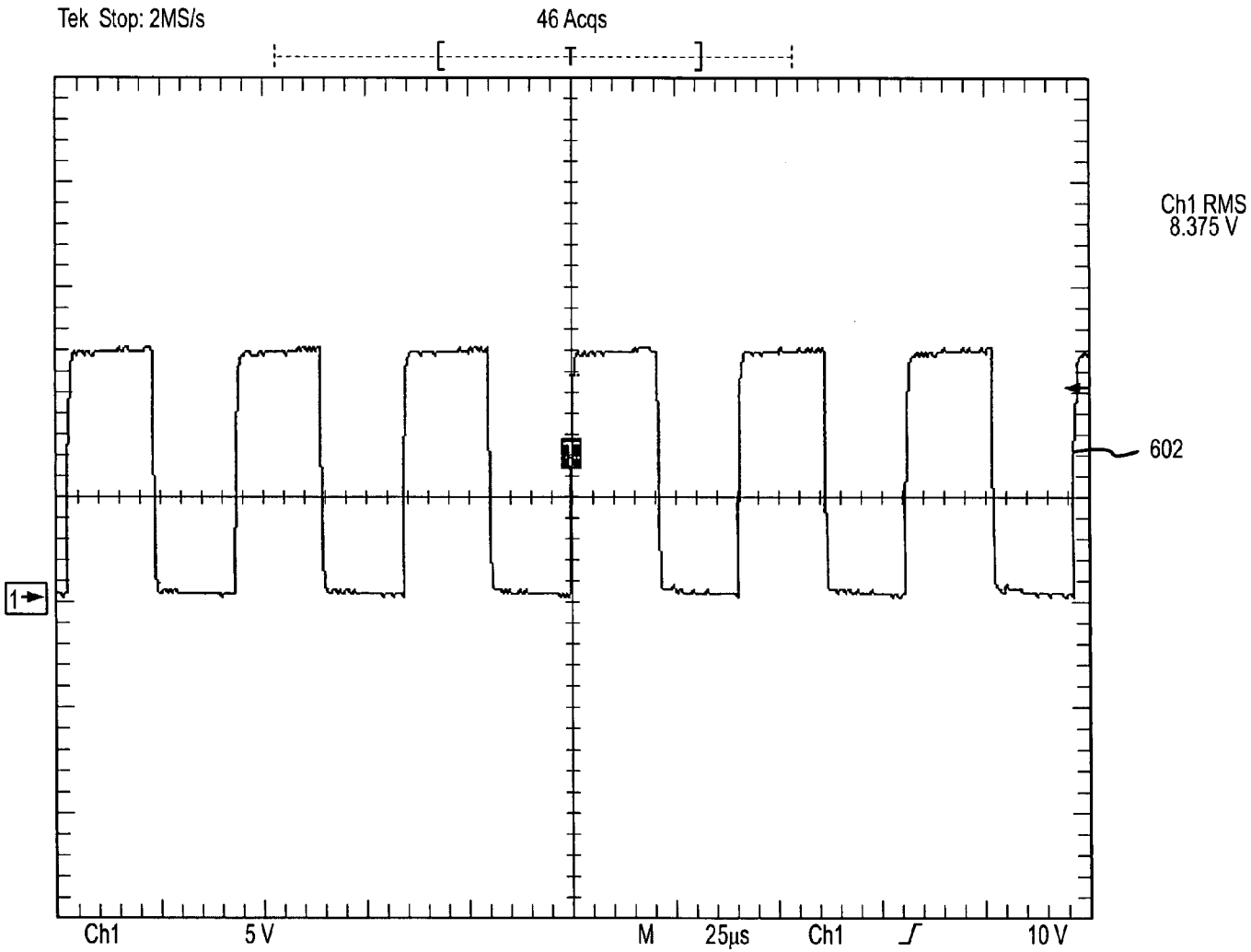
FIG. 6 shows oscilloscope traces of the output waveform from the processor module to the power switching module in the apparatus and method for standby lighting of the present invention.

Processor Module 216 has the central processing unit, which generates the appropriate switching duty cycle and frequency to maintain constant output voltage based upon the input signals it receives. Individual components of Processor Module 216 include: polarized capacitor C18; resistor R12; VCC; and Microcontroller MC1 which may be one of many types of suitable microcontrollers. In one embodiment of the invention, the components of Processor Module 216 have the following values: C18 is 3.3 μF, R12 is 5.1 k Ohms, and microcontroller MC1 is an ATtiny15L 8-bit Microcontroller with 1 K Byte Flash available from Atmel Corporation. FIG. 6 shows oscilloscope traces of the Switching Frequency Output 602 from Processor Module 216 to Power Switching Module 210 which is a twenty-five KHz switching frequency.

Auxiliary Lamp 114 is in series with inductor L3, which acts like a voltage divider. Therefore, in order to maintain a constant voltage output for Auxiliary Lamp 114 the characteristics of inductor L3 are adjusted. If the input voltage increases, the voltage in both inductor L3 and Auxiliary Lamp 114 will increase. A constant switching frequency of twenty-five KHz is maintained, and to compensate for the change in line voltage Processor Module 216 modifies the duty cycle according to the line voltage, which may range between 200–300 volts AC. For example, if the input line voltage is 200 volts AC, then the duty cycle will be 60% on and 40% off. If the input line voltage is 300 volts AC, the duty cycle will be adjusted to 30% on and 70% off. Processor Module 216 monitors the voltage level from Voltage Sensor Module 214. The signal received from Voltage Sensor Module 214 has been smoothed by resistor R11 and polarized capacitor C17. Microcontroller MC1 within Processor Module 216 has a lookup table to compare the input line voltage, and find a reload value for updating the duty cycle of the switching output to obtain a constant output voltage.

Current Sensor Module 218 senses the current from Electronic Ballast 118 and amplifies it. Individual components of Current Sensor Module 218 include: transformer T1; resistors R13, R14, R15, R16, R17, R18, and R19; polarized capacitors C19 and C20; amplifiers MC4 and MC5; and switching diodes D1 and D2. In one embodiment of the invention, the components of Current Sensor Module 218 have the following values: transformer T1 is a CSE187-L low frequency current sense transformer available from Gopher Electronics, R13 is 100.0 Ohms, R14 and R15 are 1.0 k Ohms, R16 is 39.0 k Ohms, R17 and R18 are 100.0 k Ohms, R19 is 10.0 k Ohms, C19 and C20 are 3.3 μF, amplifiers MC4 and MC5 are LM2904D single supply dual operational amplifiers available from ON Semiconductor®, and switching diodes D1 and D2 are CMOD6001 surface mount ULTRAmini™ low leakage silicon switching diodes available from Central™ Semiconductor Corp.

Processor Module 216 of Standby Lamp Module 100 has smart trigger circuitry that includes a soft start feature, overlap timer, and an advanced current sense algorithm. Processor Module 216 continuously monitors the electronic ballast current for HID Lamp 126. If the current drops below one ampere for a period of time, typically about one to two seconds, then Standby Lamp Module 100 supplies direct current to turn on Auxiliary Lamp 114 in a gradual fashion, typically from off, or no current, to on, or total current, in about one to two seconds. This soft start feature reduces the inrush of current to Auxiliary Lamp 114 and helps prolong the bulb life of Auxiliary Lamp 114 as well as Standby Lamp Module 100 itself.

Auxiliary Lamp 114 is kept on until the electronic ballast current rises to a threshold current level, typically about one ampere, for more than two seconds, then an overlap timer starts to count down for a predetermined period of time, about fifteen minutes. This time may vary depending upon the individual characteristics of the HID lamp used. This count down time will vary, more or less, depending upon the characteristics of HID Lamp 126. At the point where the electronic ballast current rises to the threshold current level and stabilizes, HID Lamp 126 starts to work properly, but the brightness is only about 20% of normal. The brightness level will increase slowly during the next fifteen minutes until 100% brightness is reached. Auxiliary Lamp 114 will be turned off when the overlap timer has count down fifteen minutes, and HID Lamp 126 has reached 100% brightness. Should the electronic ballast current drop again prior to reaching the fifteen minute count down, Processor Module 216 resets the overlap timer, and the fifteen minute count down begins again.

Figure 3:
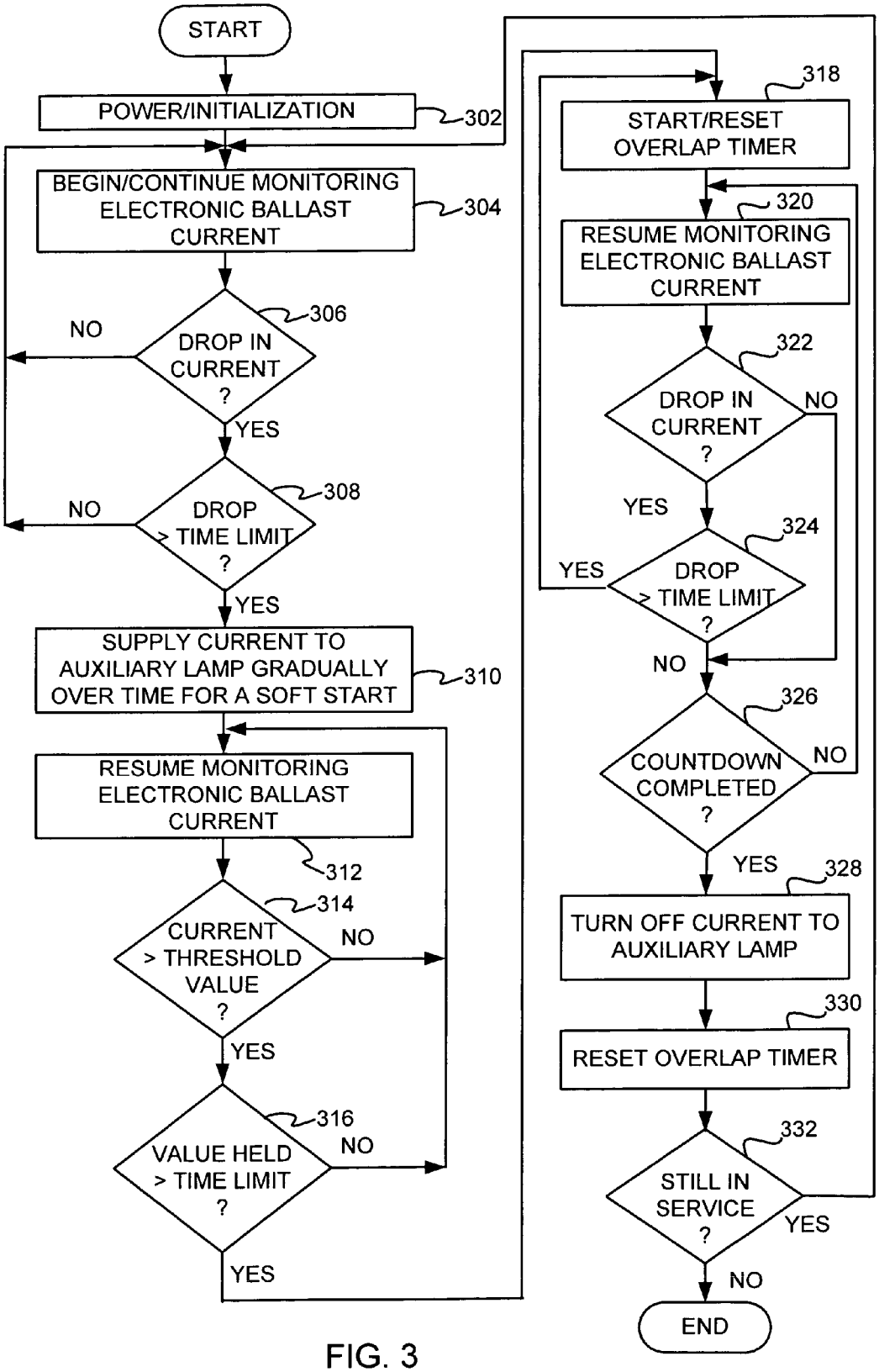
FIG. 3 shows a block flow diagram of the method of utilizing a power supply module with a standby lamp, used in conjunction with an HID lamp, of the present invention.

FIG. 3 shows a block flow diagram of the method of utilizing a power supply module with a standby lamp, used in conjunction with an HID lamp, of the present invention. Referring now to FIG. 3, the method begins in step 302 when power is initially supplied to Standby Lamp Module 100. The programs stored in the various microcontrollers initialize themselves in preparation for operation, setting ports, clocks, timers, and certain program variables.

In step 304, Processor Module 216 begins monitoring the current being supplied to Electronic Ballast 118 by Line Voltage Supply 120. Processor Module 216 continually checks in Step 306 for a drop in current below one ampere. When a drop in current is detected, then step 308 determines if the drop in current is sustained for a predetermined period of time, typically about one to two seconds. If the drop in current is less than the predetermined time, control returns to Step 304 where Processor Module 216 resumes checking for a drop in current. If step 308 determines that the drop in current exceeds the predetermined time, then in step 310 Standby Lamp Module 100 supplies current to soft start Auxiliary Lamp 114 in a gradual fashion over a predetermined period of time, typically in about one to two seconds.

In step 312, Processor Module 216 resumes monitoring the current being supplied to Electronic Ballast 118 by Line Voltage Supply 120. In step 314 Processor Module checks for a rise in current to a threshold current level, typically about one ampere. When the threshold current level is detected, then step 316 determines if the threshold current level is sustained for a predetermined period of time, typically for more than two seconds. If the threshold current level is held less than the predetermined time, control returns to Step 312 where Processor Module 216 resumes continually checking for a rise in current to a threshold current level. If step 316 determines that the threshold current level is sustained for the predetermined period of time, then in step 318 Processor Module 216 starts an overlap timer count down for an approximate fifteen minute period of time.

In step 320, Processor Module 216 resumes monitoring the current being supplied to Electronic Ballast 118 by Line Voltage Supply 120. Processor Module 216 checks in step 322 for a drop in current, typically below one ampere. If no drop in current of the predetermined amount is detected, then control flows to step 326. When a drop in current is detected, then step 324 determines if the drop in current is sustained for a predetermined period of time, typically about one to two seconds. If the drop in current is less than the predetermined time, then control flows to step 326. If step 324 determines that the drop in current exceeds the predetermined time, then control returns to step 318 where Processor Module 216 resets the overlap timer to begin again the approximate fifteen minute count down.

Step 326 determines if the count down has been completed. If not, then control returns to step 320 where Processor Module 216 continues to check for a drop in current until the count down is completed.

When step 326 determines that the count down has been completed, then in step 328 Processor Module 216 turns off the current that has been supplying Auxiliary Lamp 114, and in step 330 resets the overlap timer. In step 332, if Standby Lamp Module 100 is still in service, control returns to step 304 for continuation of the method, and if not, the method of the present invention ends.

Having described the present invention, it will be understood by those skilled in the art that many changes in construction and circuitry and widely differing embodiments and applications of the invention will suggest themselves without departing from the scope of the present invention.

What is claimed is:

1. An apparatus for standby lighting comprising:

a standby lamp module having a circuit, said circuit further comprising:

a current sensor module for sensing an alternating current from a line voltage supply;

a rectification module for converting said alternating current into a direct current;

a voltage sensor module for maintaining a constant output voltage by adjusting a switching frequency through sensing an input signal which is proportional to an input line voltage from said line voltage supply;

a processor module connectable to said current sensor module, said rectification module, and said voltage sensor module, for generating a switching duty cycle and a frequency to maintain a constant voltage direct current based upon input signals from said current sensor module and said voltage sensor module;

a power switching module connectable to said rectification module and to said processor module for outputting said constant voltage direct current; and wherein said power switching module produes said constant voltage direct current from said line voltage supply and not from a battery.

2. The apparatus according to claim 1 wherein said current sensor module further comprises a circuit having a transformer, at least one resistor, at least one polarized capacitor, at least one amplifier, and at least one switching diode.

3. The apparatus according to claim 1 wherein said rectification module further comprises a circuit having a full wave bridge rectifier, and at least one polarized capacitor.

4. The apparatus according to claim 1 wherein said voltage sensor module further comprises a circuit having at least one resistor, and at least one polarized capacitor.

5. The apparatus according to claim 1 wherein said power switching module further comprises a circuit having a low side metal oxide semiconductor field effect transistor driver, at least one polarized capacitor, at least one resistor, an inductor, a bipolar signal transistor, and a diode.

6. The apparatus according to claim 5 wherein said at least one polarized capacitor and said at least one resistor act as a snubber to reduce noise.

7. An apparatus for standby lighting comprising:

a standby lamp module having a circuit, said circuit further comprising:

a current sensor module for sensing an alternating current from a line voltage supply;

a rectification module for converting said alternating current into a direct current;

a voltage sensor module for maintaining a constant output voltage by adjusting a switching frequency through sensing an input signal which is proportional to an input line voltage from said line voltage supply;

a processor module connectable to said current sensor module, said rectification module, and said voltaae sensor module, for generating a switching duty cycle and a frequency to maintain a constant voltage direct current based upon input signals from said current sensor module and said voltage sensor module; and a power switching module connectable to said rectification module and to said processor module for outputting said constant voltage direct current; wherein said standby lamp module further comprises:

a phase in terminal connectable to said circuit;

a phase out terminal connectable to said circuit;

a neutral terminal connectable to said circuit, wherein said line voltage supply is connectable between said phase in terminal and said neutral terminal;

a first output terminal;

a second output terminal, wherein said first and second output terminals are connected to said circuit; and an auxiliary lamp connectable between said first and second output terminals, wherein said constant voltage direct current is supplied to said auxiliary lamp.

8. The apparatus according to claim 7 wherein said processor module further comprises a circuit having a polarized capacitor, a resistor, a control circuit direct current bus, and a microcontroller, wherein said processor module supplies said constant voltage direct current to said auxiliary lamp for a first predetermined period of time when said processor module detects a drop in current from said line voltage supply for a second predetermined period of time, wherein said first predetermined period of time is about fifteen minutes, and said second predetermined period of time is about one to two seconds.

9. The apparatus according to claim 8 further comprising:

a switching frequency output from said processor module to said power switching module, wherein said switching frequency output is held constant by said processor module by modifying said switching duty cycle based upon changes in said input line voltage.

10. The apparatus according to claim 9 wherein said microcontroller in said processor module further comprises:

a lookup table, wherein said processor module maintains said switching frequency output constant by comparing said input line voltage to a reload value stored in said lookup table, wherein said reload value is used to update said switching duty cycle.

11. The apparatus according to claim 9 wherein said switching frequency output has a frequency of 25 KHz.

12. The apparatus according to claim 7 further comprising:

an electronic ballast having a phase input terminal, a neutral input terminal, a first output terminal, and a second output terminal, wherein said phase out terminal of said standby lamp module is connectable to said phase input terminal, and said neutral terminal of said standby lamp module is connectable to said neutral input terminal; and a high intensity discharge lamp connectable between said first and second output terminals of said electronic ballast.

13. The apparatus according to claim 7 wherein said input line voltage is between 200 to 300 volts, said auxiliary lamp is a quartz incandescent lamp, and said constant voltage direct current is 120 volts.

14. The apparatus according to claim 1 wherein said circuit further comprises:

a first logic power supply module for regulating the voltage for said power switching module.

15. The apparatus according to claim 14 wherein said first logic power supply module further comprises at least one resistor, at least one polarized capacitor, and a zener diode.

16. The apparatus according to claim 1 wherein said circuit further comprises:

a second logic power supply module for regulating the voltage for said processor module.

17. The apparatus according to claim 16 wherein said second logic power supply module further comprises at least one resistor, at least one polarized capacitor, a zener diode, a microcontroller, and a control circuit direct current bus.

18. The apparatus according to claim 1 wherein said circuit further comprises:

an overvoltage protection module for protecting said circuit from surge peaks and overvoltage.

19. The apparatus according to claim 18 wherein said overvoltage protection module further comprises at least one polarized capacitor, a metal oxide varistor, and a fuse.

20. The apparatus according to claim 1 wherein said circuit further comprises:

an electro magnetic interference filter module for reducing electro magnetic interference emissions to said input line voltage.

21. The apparatus according to claim 20 wherein said electro magnetic interference filter module further comprises at least one polarized capacitor, and at least one inductor.

* * * * *